US006150990A

United States Patent [19]

Ramanujam et al.

[11] Patent Number: 6,150,990

[45] Date of Patent: Nov. 21, 2000

[54] METHOD FOR REDUCING CROSS-POLAR DEGRADATION IN MULTI-FEED DUAL OFFSET REFLECTOR ANTENNAS

[75] Inventors: Parthasarathy Ramanujam, Redondo Beach; Philip H. Law, Encino; Louis R. Fermelia, Redondo Beach, all of Calif.

[73] Assignee: Hughes Electronics Corporation, El Segundo, Calif.

[21] Appl. No.: 09/119,301

[22] Filed: Jul. 20, 1998

[51] Int. Cl.[7] ..... H01Q 1/28

[52] U.S. Cl. ..... 343/781 CA; 343/779; 343/840

[58] Field of Search ..... 343/779, 781 P, 343/781 CA, 781 R, 840, 839; H01Q 1/28

[56] References Cited

U.S. PATENT DOCUMENTS

| | | | |
|---|---|---|---|
| 3,394,378 | 7/1968 | Williams et al. | 343/779 |
| 3,710,341 | 1/1973 | Sciambi, Jr. | 343/779 |
| 4,236,161 | 11/1980 | Ohm | 343/781 CA |
| 4,855,751 | 8/1989 | Ingerson | 343/779 |
| 5,576,721 | 11/1996 | Hwang et al. | 343/753 |

*Primary Examiner*—Hoanganh Le
*Assistant Examiner*—Shih-Chao Chen
*Attorney, Agent, or Firm*—Terje Gudmestad; M. W. Sales

[57] ABSTRACT

A unique feed structure for improving the cross-polarization performance of a reflector antenna system is disclosed. According to the present invention, the feed structure is an array including a number of feeds, which are rotated in a predetermined fashion to yield superior cross polarization performance of the antenna system. The array feed in the center of the feed structure is positioned approximately in the focus of the antenna reflector. The array feeds located on the y-axis are slightly rotated in either a clockwise or a counter-clockwise manner. The magnitude of the rotation is proportional to the distance of the feeds from the x-axis along the y-axis. The rotation of the feeds yields significant performance in cross polarization performance, while having little or no co-polarization effect.

16 Claims, 8 Drawing Sheets

METHOD FOR REDUCING CROSS-POLAR DEGRADATION IN MULTI-FEED DUAL OFFSET REFLECTOR ANTENNAS

BACKGROUND OF THE INVENTION

1. Field of the Invention

The present invention relates generally to antennas and, more particularly to a method for reducing cross-polar degradation in array-feed dual offset reflector antennas.

2. Description of Related Art

Long distance communications and high-resolution radar applications require antennas having high gain. Reflector-type antenna systems are the most common and widely used high gain antennas. Reflector antennas operating at microwave frequencies routinely achieve gains in excess of 30 dB.

Many applications, such as satellite spot beam coverage of specific geographic areas, require the use of multiple beams from a single reflector antenna. The need for multiple beams is especially pronounced in the Ka band of operation. Ka frequency band signals, such as those from satellite transmitters, are highly attenuated by propagation and atmospheric effects and, therefore, require high gain spot beams to adequately cover required geographic areas.

Synthesis of multiple beams using a single reflector antenna requires the use of dual polarization reflector antennas. Dual polarization reflector antennas can be implemented using dual gridded reflectors or multiple reflectors. Dual gridded reflectors use two orthogonally polarized reflector surfaces that are fed individually by a single feed or an array of feeds. The two reflector surfaces may be parabolic or specially shaped. Each polarization grid is designed to only reflect one polarization of electromagnetic energy. Therefore, the polarization purity of the radiation pattern produced by the antenna is achieved through the use of two polarization grids.

Dual reflector systems utilize a main reflector and a subreflector. Two common configurations of dual reflector antennas are known as "Gregorian" and "Cassegrain." Typically, the main reflector is specially shaped or parabolic and the subreflector is ellipsoid in shape for a Gregorian configuration or hyperboloid in shape for a Cassegrain configuration. In dual reflector systems neither reflector is polarized and, therefore, reflects all polarizations of electromagnetic energy.

When two different polarizations are used on a dual reflector system, cross polarization performance of the system is very important. Optimum cross polarization performance may be achieved through the "Mitzuguchi condition," which is a relationship that governs the location of an antenna feed with respect to the main reflector and the subreflector focal axes. However, the "Mitzuguchi condition" pertains only to the antenna feed at the focus of the reflector system. It is common to feed a reflector system with an array of feeds, only one of which can be in the focus of the reflector system. That is, the feed located in the focus of the system will have optimum cross polarization performance, but off-focus feeds will suffer degraded cross polarization performance.

Referring now to FIG. 1*a,* a Gregorian dual reflector antenna 10 is shown. The Gregorian dual reflector antenna 10 includes a reflector 14, a subreflector 18, and a feed array 22. The feed array 22, which includes a number of feeds, irradiates the subreflector 18 with electromagnetic energy. The electromagnetic energy is, in turn, transferred from the subreflector 18 to the reflector 14 and radiated to a target from the reflector 14. In the receive situation, electromagnetic energy incident on the reflector 14 is reflected to the subreflector 18. The subreflector 18, in turn, irradiates the feed array, which may be used to convert the electromagnetic energy into voltage for processing by external circuitry (not shown). FIG. 1*b* represents a Cassegrain dual reflector antenna 11, which also includes a reflector 14, a subreflector 18, and a feed array 22.

Spatial relations in a dual reflector system are made with respect to a Cartesian coordinate system having right-handed reference axes and an origin. The origin represents a reference location in the dual reflector system where x, y, and z are all equal to zero. In the Gregorian dual reflector antenna 10 shown in FIG. 1*a*, the origin of the reference axes of the right-handed coordinate system is located at the feed array in the focus point of the subreflector 18. The z-axis points directly from the origin to the bisector of the subreflector 18. The x-axis, which is at a 90° angle to the z-axis, is oriented as shown in FIG. 1*a.* The positive y-axis points from the origin directly into the plane of the paper, which is defined by the x-z plane. The x-y plane bisects the subreflector 18 into first and second portions of equal size. Similarly, the y-z plane bisects the subreflector into third and fourth portions.

FIG. 2 is a diagram illustrating a feed array 22 that may be used to feed the subreflector 18. The feed array 22 includes a plurality of individual feeds 30. While the feed array shown in FIG. 3 includes twenty-five individual feeds 30, the size of the feed array 22 is limited only by the physical constraints of the application. Therefore, some feed arrays 22 may include relatively few individual feeds 30, and some feed arrays 22 may include hundreds or even thousands of feeds 30. A center feed 35 of the feed array 22 is located in the origin of the coordinate system as shown in FIGS. 1 and 2.

FIG. 3 is a diagram of a feed array 22' illustrating nine individual feeds 30 numbered 1–9 that are used to feed the subreflector 18 of the Gregorian dual reflector system 10. The axes of the graph indicate azimuth and elevation of the feeds with respect to the focus of the reflector system. Again, as in FIG. 2 the center feed 35 (feed three) is located directly in the center of the focus and the remaining individual feeds 30 are off-focus as shown. All of the feeds 30, 35 of the feed array 22' are oriented in the same direction. That is, none of the individual feeds 30 shown in FIG. 3 are rotated either clockwise or counterclockwise in the x-y plane. The configuration shown in FIG. 3 is merely exemplary of the types of feed arrays that may be used in conjunction with a reflector antenna system.

FIG. 4 is a plot of the co-polarization performance of the feed array 22' shown in FIG. 3. The co-polarization performance of the feed array 22' is approximately uniform for each of the nine individual feeds 30.

FIG. 5 is a plot of the cross polarization performance of the Gregorian antenna system with the feed structure shown in FIG. 3 and the co-polarization performance shown in FIG. 4. The center feed 35 (feed three) is located in the focus of the reflector system and, therefore, has the best cross polarization performance at −0.37. Conversely, feeds one and five, which are located farthest from the focus, have cross polarization level approximately 20 dB higher than feed three. The feeds 30 farthest from feed three along the y-axis, which is in the focus of the subreflector, have the poorest cross polarization performance. As feeds 30 are positioned closer to feed three along the y-axis, their cross polarization performance improves. Although the results shown in FIG.

4 are for the feed array 22' having nine feeds, the trend of poor cross polarization performance for off-focus feeds is found in every antenna feed configuration.

Because of the need for high gain and multiple beam systems, reflector antennas that are fed with an array of feeds are desirable. However, it can be appreciated that the cross polarization performance of an array fed system is crucial to optimal system performance. Therefore, the need for a reflector system that can be fed with a feed array and has good cross polarization performance can readily be appreciated.

SUMMARY OF THE INVENTION

The present invention is embodied in a reflector antenna system including a reflector having a focus and a feed array. The feed array includes a first feed located in the focus of the reflector, a second feed and a third feed adjacent the first feed, the second feed and the third feed forming a first tier of feeds. The present invention further includes a fourth feed adjacent the second feed and a fifth feed adjacent the third feed. According to the present invention, the fourth feed and the fifth feed form a second tier of feeds, wherein the first tier of feeds is rotated a first magnitude with respect to the first feed; and wherein the second tier of feeds is rotated a second magnitude with respect to the first feed.

According to another aspect, the present invention may be embodied in a method of improving a cross polarization performance of a reflector antenna system. The method includes the steps of providing a reflector comprising a focus, and providing a feed array. In accordance with the present invention the feed array includes a first feed located in the focus of the reflector, a second feed and a third feed adjacent the first feed, the second feed and the third feed forming a first tier of feeds. The present invention also includes a fourth feed adjacent the second feed and a fifth feed adjacent the third feed. The fourth feed and the fifth feed form a second tier of feeds. The method of the present invention further includes the steps of rotating the first tier of feeds a first magnitude with respect to the first feed and rotating the second tier of feeds a second magnitude with respect to the first feed.

The invention itself, together with further objects and attendant advantages, will best be understood by reference to the following detailed description, taken in conjunction with the accompanying drawings.

DESCRIPTION OF THE PREFERRED EMBODIMENTS

The present invention utilizes rotated feeds in the feed structure to obtain superior cross polarization performance to feed systems that are currently known. The present invention rotates the position of each array feed on the y-axis of the feed array with respect to a feed in the focus of the reflector. The axes of rotation of the feeds are in the direction of the z-axis. The rotation of off-focus feeds optimizes cross polarization performance of the antenna system. The feeds adjacent to the feed in the focus, form a first tier of feeds. The two first tier feeds are rotated by a first magnitude. Each of the first tier feeds are rotated opposite one another. That is, if one of the first tier feeds is rotated clockwise, the other first tier feed is rotated counterclockwise. Adjacent to the first tier feeds are second tier feeds, each of which is rotated in the same direction as its adjacent first tier feed. However, the second tier feeds are rotated with a greater magnitude than the first tier feeds. That is, the magnitude of rotation of the feeds is proportional to the feed distance from the feed in the focus. The concept of rotating feeds based on their position in the feed array may be applied to many different feed array configurations and is not limited to the examples given.

Figure 4:
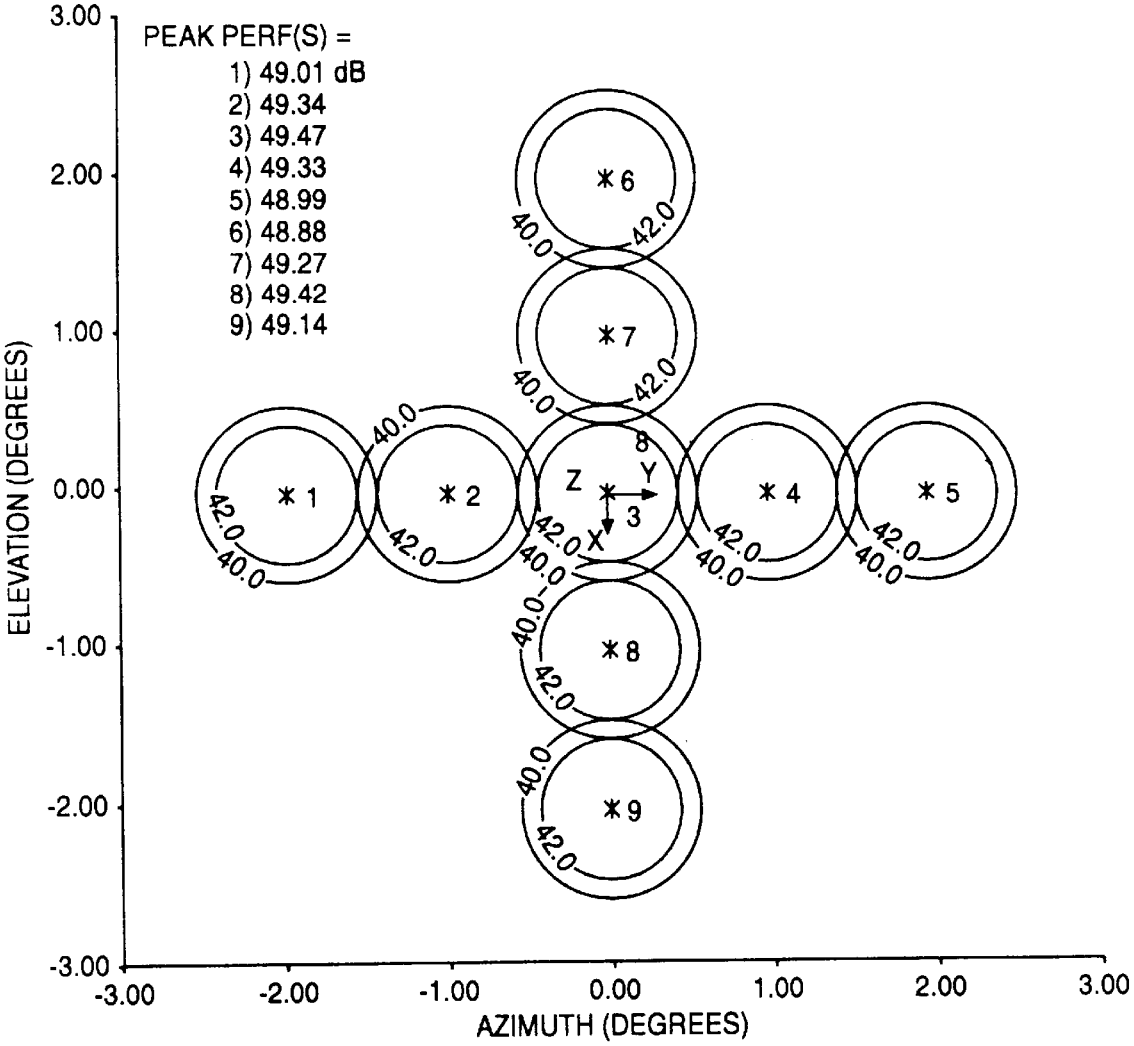
(PRIOR ART) FIG. 4
FIG. 4 is a plot of the co-polarization performance of the Gregorian antenna system using the feed structure shown in FIG. 3.
Figure 5:
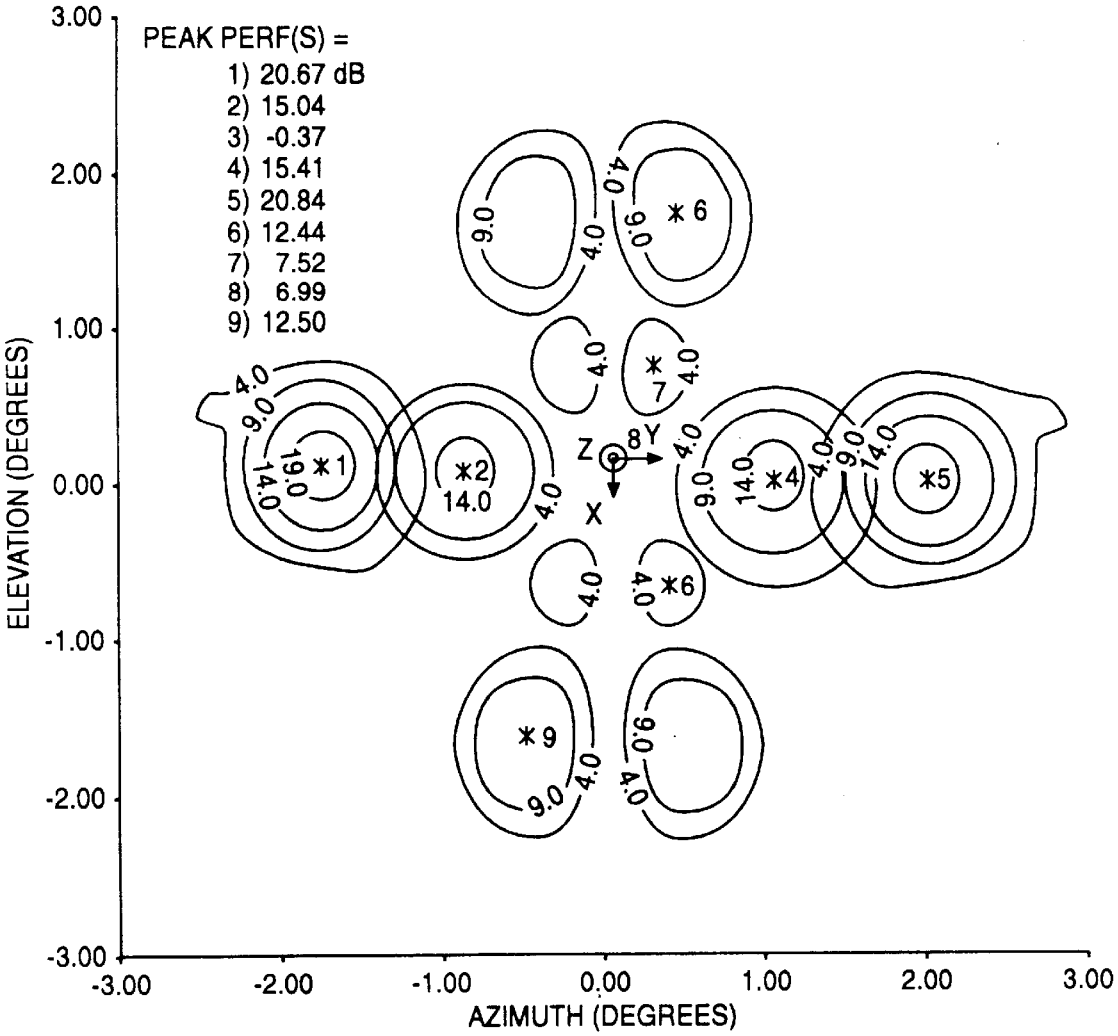
(PRIOR ART) FIG. 5
FIG. 5 is a plot of the cross polarization performance of the Gregorian antenna system using feed structure shown in FIG. 3.
Figure 6:
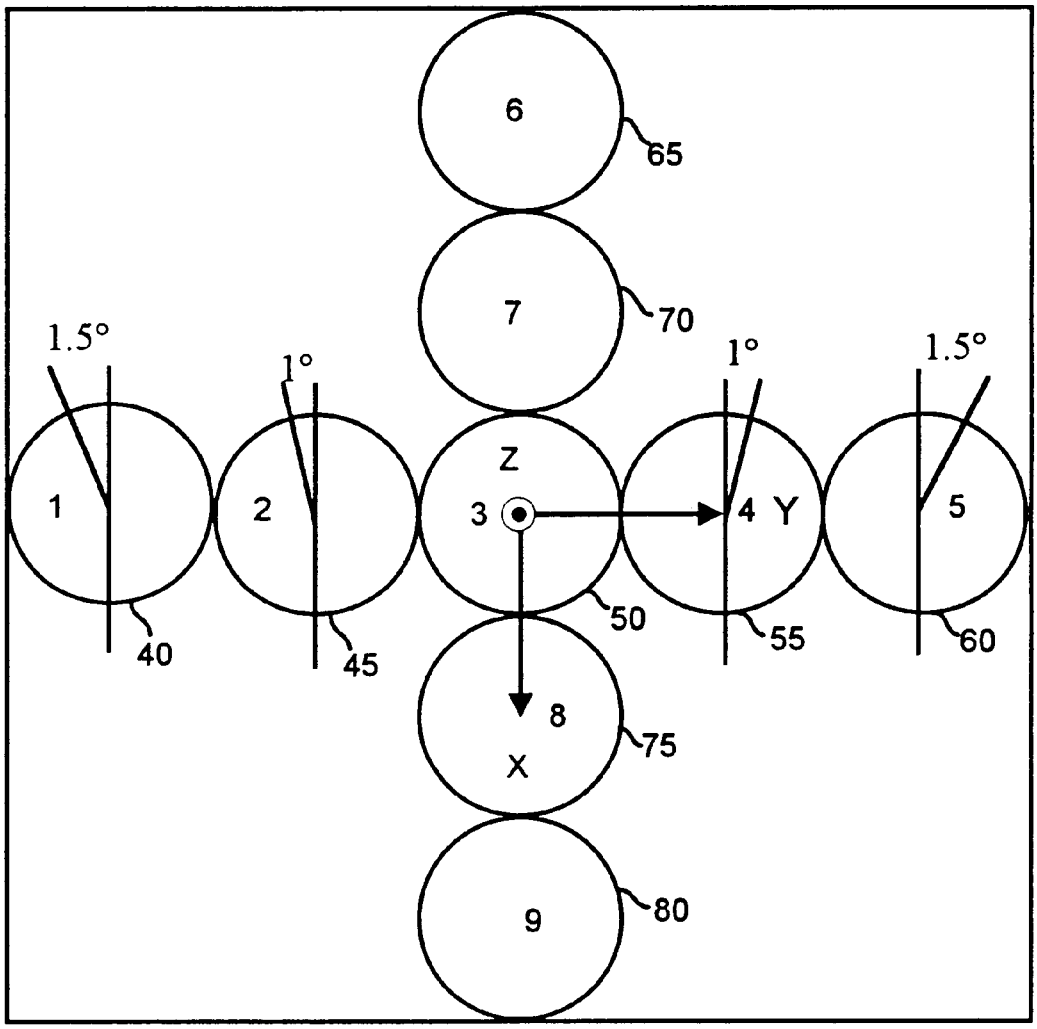
FIG. 6 is a diagram of an exemplary feed array having nine feeds that are rotated in accordance with the present invention.
Figure 7:
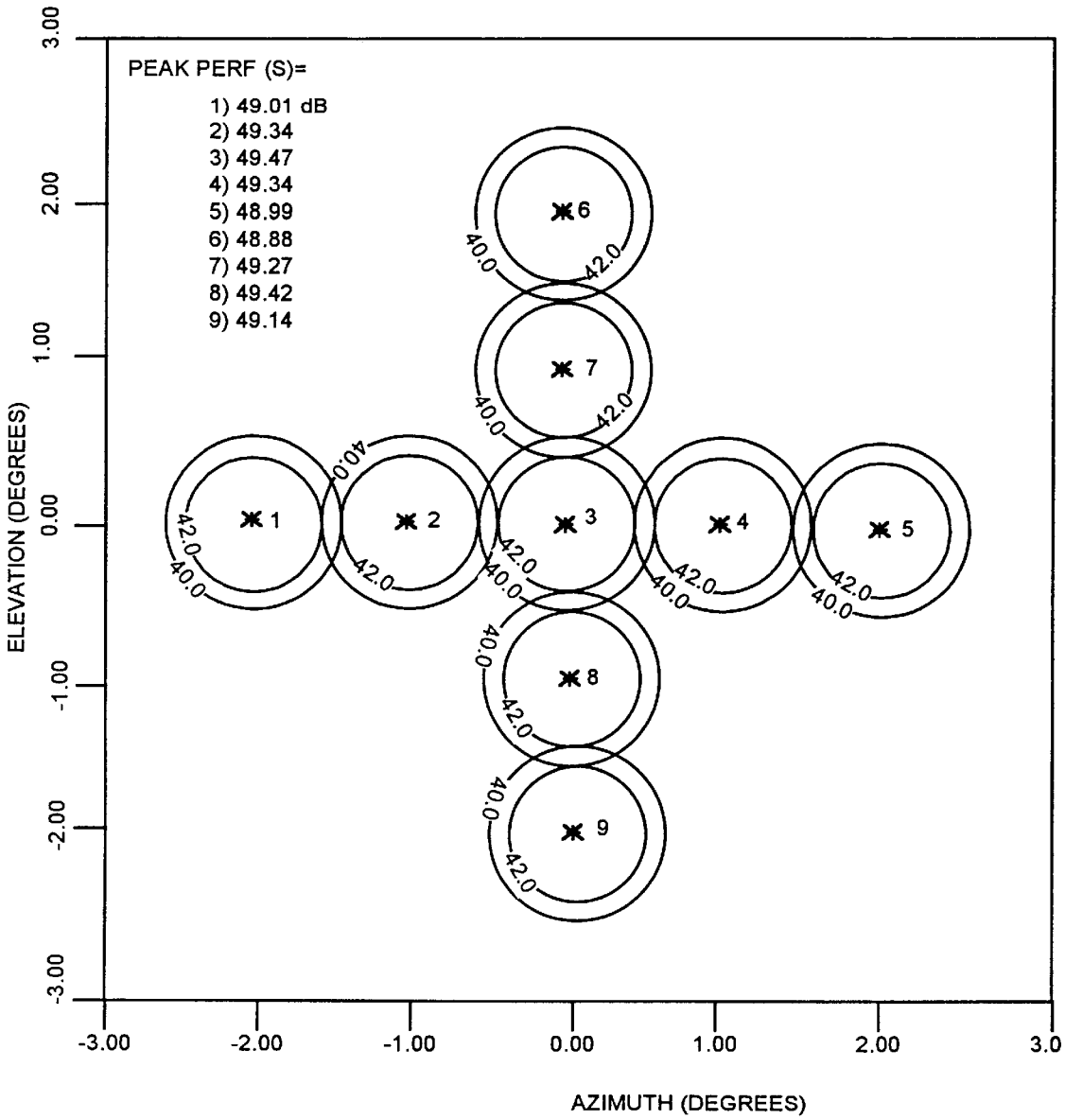
FIG. 7 is a plot of the co-polarization performance of the Gregorian antenna system using the rotated feed structure of the present invention.

Referring now to FIG. 6, a diagram illustrating an exemplary rotated feed structure of the present invention is shown. Feeds 1, 2, 4, and 5, reference numbers 40, 45, 55, and 60 respectively, are rotated clockwise and counterclockwise with respect to a feed in the focus 3 50. Feed 3 50 must be located precisely (e.g. within thousandths of an inch) in the focus of the subreflector 18. If feed 3 50 is not precisely located, the beam coverage of the reflector antenna 10 will change. Table 1 denotes the magnitudes and the directions of rotation for each feed shown in FIG. 6. Specifically, feed 1 40 and feed 2 45 are rotated counterclockwise 1° and 1.5°, respectively, and feed 4 55 and feed 5 60 are rotated clockwise 1.5° and 1°, respectively. This rotation has no effect on the co-polarization performance of the feed array. The magnitude of the rotation is proportional to the distance of the feed from the origin along the y-axis, which is why feeds 6, 7, 8, and 9, 65, 70, 75, and 80 respectively, are not rotated. As shown in FIG. 7, the co-polarization performance of the rotated feed structure of the present invention is approximately uniform for feeds one to nine. A comparison between FIGS. 4 and 7 reveals that the rotation of array feeds 1, 2, 4, and 5 40, 45, 55, and 60 respectively, yields substantially similar co-polarization performance. The rotation magnitudes (angles) shown in Table 1 are exemplary rotations determined in accordance with the present invention. In actual application, one skilled in the art would empirically determine the optimum rotation angle for best cross polarization performance of each of the feeds along the y-axis. However, in accordance with the present invention, the directions of rotation of the feeds on opposite sides of the feed in focus 50 will be opposite. Additionally, in accordance with the present invention, the magnitude (angle) of rotation of the feeds will increase with feed distance from the feed in the focus 50.

Figure 8:
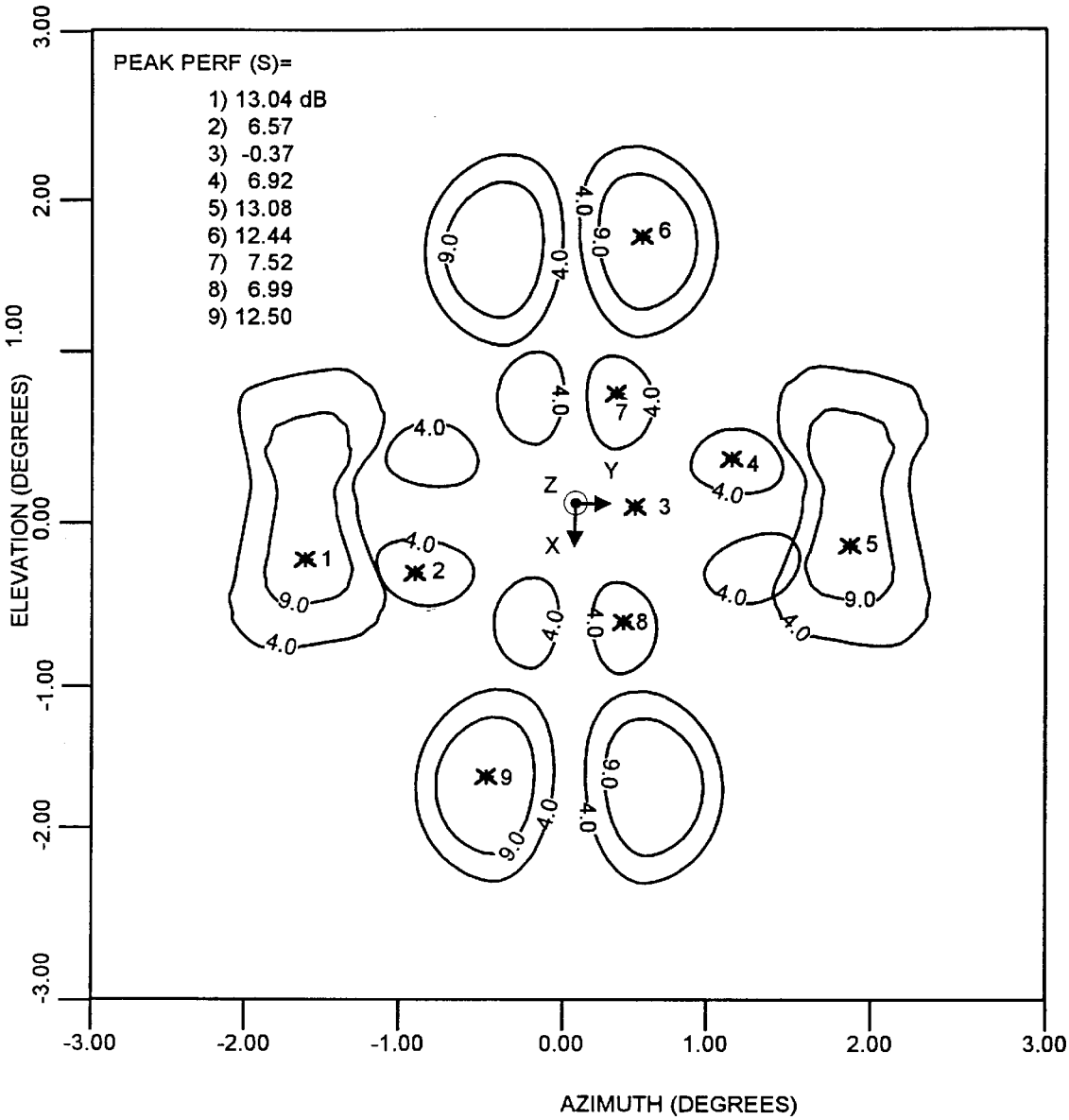
FIG. 8 is a plot of the cross polarization performance of the Gregorian antenna system using the rotated feed structure of the present invention.

FIG. 8 illustrates the cross-polarization performance of a feed structure of the present invention having feeds rotated according to Table 1. The rotation of the feeds improves the cross-polarization performance of the rotated feeds by 7.5 to 6.5 dB. The effect of rotation on cross-polarization performance can be seen in Table 1.

TABLE 1

| Feed Number | Optimum Feed Rotation Angle (degrees) | Peak Cross-polar Level Before Rotation (dBi) | Peak Cross-polar Level After Rotation (dBi) | Reduction in Peak Cross-polar Level (dB) |
|---|---|---|---|---|
| 1 | 1.5 | 20.67 | 13.04 | 7.63 |
| 2 | 1.0 | 15.04 | 6.57 | 8.47 |
| 3 | 0.0 | −0.37 | −0.37 | 0.00 |
| 4 | −1.0 | 15.41 | 6.92 | 8.49 |
| 5 | −1.5 | 20.84 | 13.08 | 7.76 |
| 6 | 0.0 | 12.44 | 12.44 | 0.00 |
| 7 | 0.0 | 7.52 | 7.52 | 0.00 |
| 8 | 0.0 | 6.99 | 6.99 | 0.00 |
| 9 | 0.0 | 12.50 | 12.50 | 0.00 |

Figure 1A:
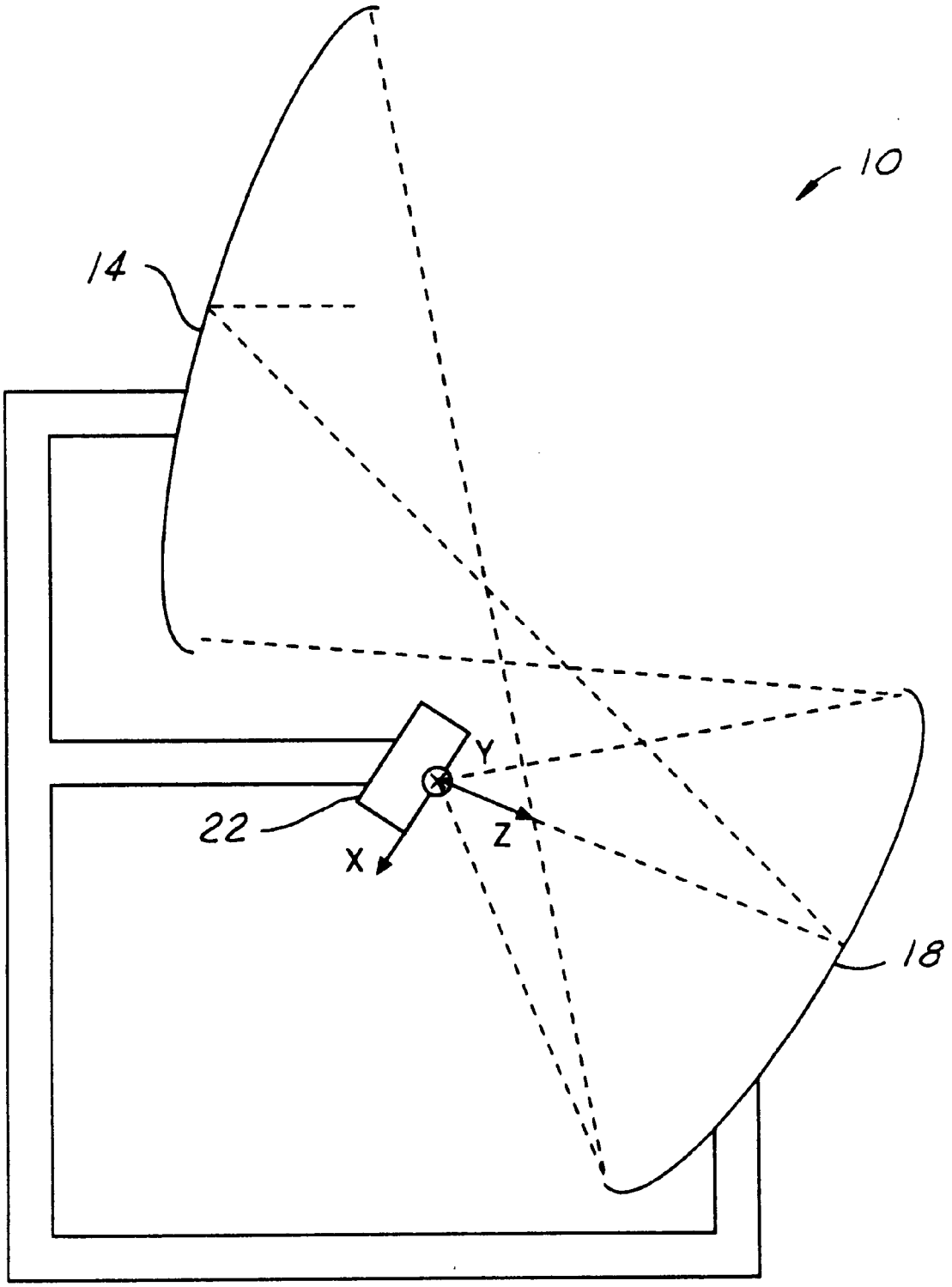
(PRIOR ART) FIG. 1a
FIG. 1*a* is a diagram of a Gregorian dual reflector antenna system.
Figure 1B:
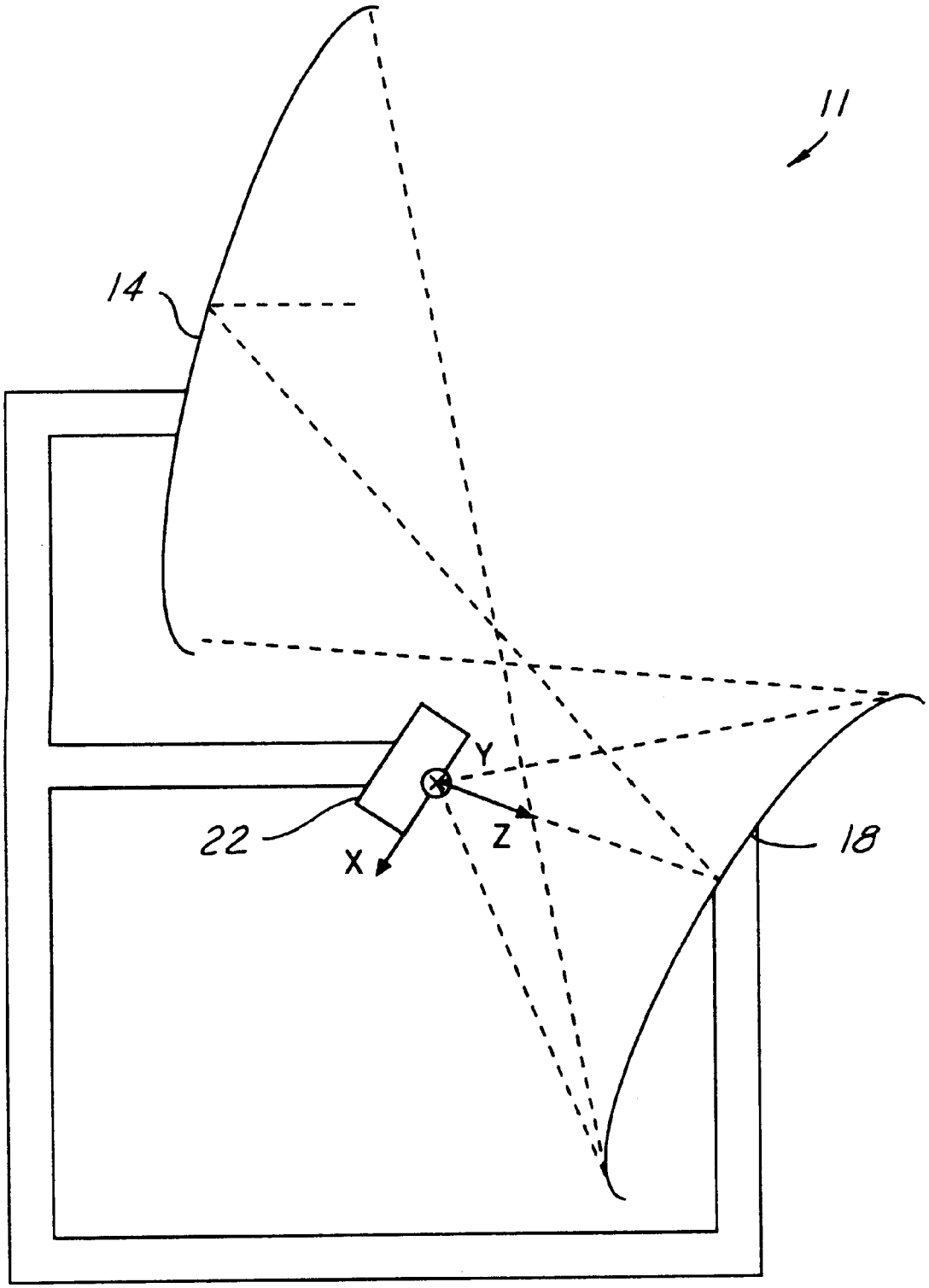
(PRIOR ART) FIG. 1b
FIG. 1*b* is a diagram of a Cassegrain dual reflector antenna system.
Figure 2:
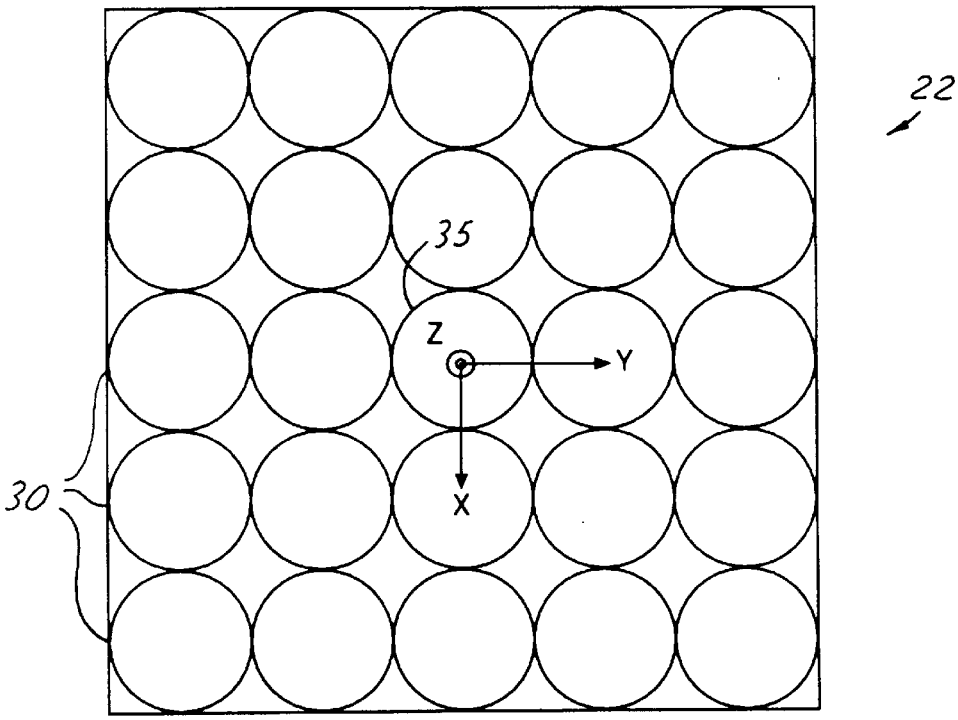
(PRIOR ART) FIG. 2
FIG. 2 is a diagram of a feed array that may be used to feed the Gregorian dual reflector system shown in FIG. 1*a;*
Figure 3:
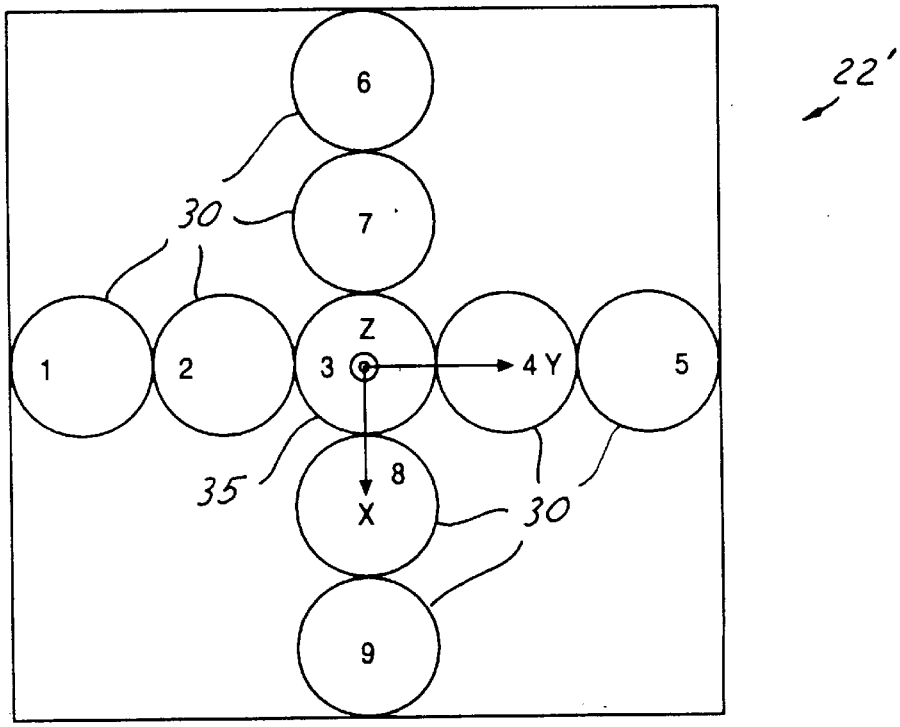
(PRIOR ART) FIG. 3
FIG. 3 is a diagram of an exemplary feed array having nine feeds.

While the results in Table 1 are relevant to the nine feed rotated structure shown in FIG. 6, the teachings of the present invention are applicable to feed arrays of many shapes and sizes. Specifically, the teachings of the present invention may be used in conjunction with feed arrays such as shown in FIG. 2 or other feed array structures.

Therefore, it can be seen from the foregoing detailed description that the present invention provides a unique feed structure for improving the cross-polarization performance of a reflector antenna system. According to the present invention, the feed structure is an array including a number of feeds, which are appropriately rotated to yield superior cross polarization performance of the antenna system. The array feed in the center of the feed structure is positioned in the focus of the antenna reflector. The array feeds located on the y-axis that are slightly rotated in either a clockwise or a counterclockwise manner. The magnitude of the rotation is proportional to the distance of the feeds from the x-axis along the y-axis. The rotation of the feeds yields significant enhancement in cross polarization performance, while having little or no co-polarization effect.

Of course, it should be understood that a range of changes and modifications can be made to the preferred embodiment described above. For example, the feed structure may be on a hexagonal or rectangular lattice; the feed apertures may be aligned on a planar surface or may be distributed on a curved surface; and the number of feeds may be increased far above the nine feed simulations used to illustrate the present invention. It is therefore intended that the foregoing detailed description be regarded as illustrative rather than limiting and that it be understood that it is the following claims, including all equivalents, which are intended to define the scope of this invention.

What is claimed is:

1. A reflector antenna system comprising:

a reflector having a focus; and a feed array comprising:

a first feed located approximately in the focus of the reflector;

a second feed adjacent the first feed, wherein the second feed is rotated a first magnitude with respect to the first feed.

2. The feed array of claim 1, further comprising:

a third feed adjacent the first feed, the second feed and the third feed forming a first tier of feeds, wherein the third feed is rotated a first magnitude with respect to the first feed.

3. The feed array of claim 2, further comprising:

a fourth feed adjacent the second feed;

a fifth feed adjacent the third feed;

wherein, the fourth feed and the fifth feed form a second tier of feeds;

wherein the second tier of feeds is rotated a second magnitude with respect to the first feed.

4. The reflector antenna system of claim 3, wherein the first magnitude of rotation is less than the second magnitude of rotation.

5. The reflector antenna system of claim 2, wherein the second feed is rotated an opposite direction from the third feed.

6. The reflector antenna system of claim 1, wherein the reflector comprises a subreflector.

7. The reflector antenna system of claim 1, wherein the reflector comprises a component of a Gregorian antenna system.

8. The reflector antenna system of claim 1, wherein the reflector comprises a component of a Cassegrain antenna system.

9. A method of improving a cross polarization performance of a reflector antenna system comprising the steps of:

providing a reflector comprising a focus; and providing a feed array comprising:

a first feed located approximately in the focus of the reflector;

a second feed adjacent the first feed;

rotating the second feed a first magnitude with respect to the first feed.

10. The method of claim 9, further comprising the steps of:

providing a third feed adjacent the first feed, the second feed and the third feed forming a first tier of feeds;

rotating the first tier of feeds a first magnitude with respect to a the first feed.

11. The method of claim 10, further comprising the steps of:

providing a fourth feed adjacent the second feed;

providing a fifth feed adjacent the third feed;

wherein, the fourth feed and the fifth feed form a second tier of feeds;

rotating the second tier of feeds a second magnitude with respect to the first feed.

12. The method of claim 11, wherein the first magnitude of rotation with respect to the first feed is less than the second magnitude of rotation with respect to the first feed.

13. The method of claim 10, wherein the step of rotating the first tier of feeds comprises rotating the second feed an opposite direction from the third feed.

14. The method of claim 9, wherein the reflector comprises a sub-reflector.

15. The method of claim 9, wherein the reflector comprises a component of a Gregorian antenna system.

16. The method of claim 9, wherein the reflector comprises a component of a Cassegrain antenna system.

* * * * *